US007255112B2

(12) United States Patent
Geret et al.

(10) Patent No.: US 7,255,112 B2
(45) Date of Patent: Aug. 14, 2007

(54) PROCESS OF REMOVING STAINS

(75) Inventors: Laurence Geret, Ludwigshafen (DE); Gunnar Noeding, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/535,611

(22) PCT Filed: Nov. 18, 2003

(86) PCT No.: PCT/GB03/05021

§ 371 (c)(1),
(2), (4) Date: Jun. 20, 2005

(87) PCT Pub. No.: WO2004/048507

PCT Pub. Date: Jun. 10, 2004

(65) Prior Publication Data

US 2006/0042662 A1 Mar. 2, 2006

(30) Foreign Application Priority Data

Nov. 22, 2002 (GB) ..... 0227291.2

(51) Int. Cl.
*B08B 9/20* (2006.01)

(52) U.S. Cl. ..... 134/25.2; 134/25.1; 510/220; 510/221; 510/224; 510/226; 510/233; 510/243; 510/361; 510/370; 510/372; 510/374

(58) Field of Classification Search ..... 134/25.2, 134/25.1; 510/220, 221, 224, 226, 233, 243, 510/361, 370, 372, 374
See application file for complete search history.

(56) References Cited

U.S. PATENT DOCUMENTS 3,272,750 A 9/1966 Chase ..... 252/99
4,681,592 A 7/1987 Hardy et al. ..... 8/111
5,043,089 A 8/1991 Nollet et al. ..... 252/95

FOREIGN PATENT DOCUMENTS

| | | |
|---|---|---|
| EP | 0402339 A1 | 12/1990 |
| WO | WO 93/07086 | 4/1993 |
| WO | WO 96/17921 | 6/1994 |
| WO | WO 95/19132 A1 | 7/1995 |
| WO | WO 96/33259 | 10/1996 |
| WO | WO 02/083829 A | 10/2002 |

OTHER PUBLICATIONS

International Preliminary Examination Report dated Mar. 14, 2005 for Application PCT/GB03/05021.

Written Opinion dated Sep. 1, 2004 for Application PCT/GB03/05021.

Response (dated Nov. 29, 2004) to Written Opinion for Application PCT/GB03/05021.

Combined Search and Examination Report from The Patent Office in Great Britain dated Apr. 30, 2003 for Application GB 0227291.2.

International Search Report dated Feb. 13, 2004 for application PCT/GB03/05021.

*Primary Examiner*—Zeinab El-Arini
(74) *Attorney, Agent, or Firm*—Norris McLaughlin & Marcus, PA

(57) ABSTRACT

A process for removing colored stains from hydrophobic surfaces characterized in that the process involves the use of a formulation which comprises a salt of sulphophenyl alkyl carbonate is described. Also a process of removing color stains from a plastics material, characterized in that the stained plastics material is treated in a dishwashing machine with a formulation comprising a salt of sulphophenyl alkyl carbonate is described.

12 Claims, No Drawings

PROCESS OF REMOVING STAINS

The present invention relates to a process of removing coloured stains from hydrophobic surfaces especially plastic surfaces by treating with a formulation comprising a salt of sulphophenyl alkyl carbonate.

The removal of stains, especially coloured stains, from materials is a well recognised issue. Typically the stains are addressed using a composition comprising one or more of the following components; bleach, solvent and detergent.

In the area of automatic washing, such as in automatic laundry and dishwashing machines, peroxide bleaches are often used to remove stains. The bleaches act upon the stained materials, oxidising the stain causing compounds. The oxidation reaction acts in a two-fold mechanism aiding the removal of colour from the stain (by destructive oxidation thereof) and the removal of the stain causing compounds from the substrate.

Due to their utility peroxide-containing bleaching agents have been used in washing and cleaning processes for some time. Such agents are particularly useful in dishwasher applications to aid the removal of foodstuff residues and stains produced on crockery and other kitchenware in cooking processes. Their action is particularly important on coloured stains such as those produced by tomato based foodstuffs and tea.

However, although peroxide-containing bleaching agents have been found to perform well at a wash liquor temperature of 90° C. and above, their performance noticeably decreases with lower temperatures. Thus when items are washed at lower temperatures, there can be a problem of incomplete stain removal. This is unpleasant from an aesthetic point of view and also can present detrimental hygiene issues.

It is known that various agents (commonly known as bleach activators) catalyse the decomposition of $H_2O_2$. In this way it is possible to increase the bleaching action of $H_2O_2$, or of precursors that release $H_2O_2$, or of other peroxo compounds, the bleaching action of which is unsatisfactory at lower temperatures. Thus acceptable bleaching activity can be obtained at lower temperatures and shorter wash times.

Example of a bleach activator include carbonate esters. The carbonate esters react with hydrogen peroxide and peroxide sources to increase bleaching activity. The use of carbonate esters in this way in laundry and textile detergent formulations has been described in, for example U.S. Pat. No. 5,043,089 (Akzo NV) and U.S. Pat. No. 4,681,592 (Procter & Gamble).

There is an area where automatic dishwashing detergents (ADD) still fail to deliver the perfect results that the users of ADD products have come to expect from these products. Namely in the cleaning of hydrophobic surfaces (such as the cleaning of plastics), which have been stained by coloured soils coming from their contact with food—poor stain removal has been observed. In effect, it has been observed that some coloured foods when left in prolonged contact with hydrophobic surfaces, can stain the surface and further these stains are stubborn and cannot be completely removed with conventional ADD products. Examples of hydrophobic surfaces, which can get stained by coloured food, are plastic containers for food (i.e. Tupperware® items), plastic dishes and plastic elements of the dishwasher.

It has been observed that, although the food ingredients responsible for the staining are normally bleached effectively by strong oxidants in solution (i.e. sodium hypochlorite bleaches), once they have caused a stain in plastic the stain is no longer bleachable with the strong oxidants.

Solutions have been proposed in the art to improve the removal of food coloured stains from plastic in dishwashing machines. These solutions are based on the use of very strong oxidants. One example of such an oxidant is described in PCT application number 95/19132 A1 where it is proposed to use diacyl or tetraacyl peroxides as bleaching species to enhance the removal of bleachable food soils from plastic.

This solution presents however a number of drawbacks. One of the major drawbacks when using not only diacyl or tetraacyl peroxides but also other strong oxidants is the limited compatibility of these ingredients with bleach sensitive ingredients which are desirable in ADD formulations (i.e. enzymes, perfumes, etc.). As a consequence it is normally necessary to take special measures to assure the stability of the formulation comprising both the strong oxidants and the bleach sensitive ingredients. Examples of such measures are the segregation of the incompatible ingredients in different phases of the formulations (i.e. in different regions of a tablet), coating one of the ingredients or maintaining it in an isolated state (i.e. by insolubilisation in a liquid matrix) to reduce its interaction with the rest of the formulation.

Another drawback of using diacyl or tetraacyl peroxides (and also other strong oxidants) is their lack of stability at high temperatures for which reason it has been proposed in WO 93/07086 that they are used in the form of their clathrates with urea or that they are formulated by forming particles with a stabilizing additive (EP 0 796 317 B1).

Still another drawback of diacyl peroxides is that when used in dishwashing processes at their conventional granulometry of 400 to 700 microns, a problem of residue formation occurs as reported by EP 0 821 722 B1. According to this document the alternative of using diacyl peroxides of smaller particles size incorporated into granular detergent compositions will generate segregation problems.

Due to the above mentioned difficulties an unmet need remains to find alternative ingredients which are capable of delivering a good performance in relation with the removal of coloured food stains from plastic, when the dishwashing detergent comprising them are used to treat the stained plastic in an automatic dishwashing machine. It would also be an additional advantage that the alternative ingredients be fully compatible with the conventional detergent ingredients (i.e. with ingredients incompatible with oxidants) and thus could be easily incorporated into dishwashing detergent formulations.

It is an object of the present invention to obviate/mitigate the problems outlined above.

According to a first aspect of the invention there is provided a process for removing coloured stains from hydrophobic surfaces characterised in that the process involves the use of a formulation which comprises a salt of sulphophenyl alkyl carbonate.

Most preferably the salt is an alkali metal salt, particularly sodium.

It is preferred that the sulpho-moiety is disposed at the para position of the phenyl It is most preferred that the alkyl moiety comprises an octyl ($C_8$) moiety.

Thus most preferably the salt of sulphophenyl alkyl carbonate is sodium p-sulphophenyl octyl carbonate.

In use it is recognised that aryl allyl carbonates are able to react with hydrogen peroxide and also hydrogen peroxide generators and other peroxy compounds to yield a peracid.

The reaction pathway for this interaction is shown below (using sodium p-sulphophenyl octyl carbonate for illustration purposes).

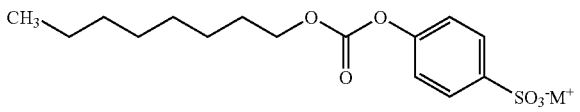

when exposed to a peroxide source/generator reacts to yield the peracid below

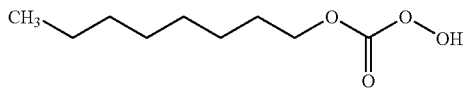

It has been found that a formulation comprising sodium p-sulphophenyl octyl carbonate (pictured above) is particularly effective at removing coloured stains (particularly food stains such as those caused by tomatoes) from hydrophobic materials. Without wishing to be bound by theory it is proposed that in use, the unreacted sodium p-sulphophenyl octyl carbonate and the peracid produced therefrom are able to become adsorbed onto the hydrophobic surface, then by reaction of the food stain compound with the peracid the food stain is removed and/or bleached. It is suggested that the hydrophobic component of the sodium p-sulphophenyl octyl carbonate, namely the octyl chain, is able to interact with the hydrophobic surface and the typically hydrophobic staining molecule, this easing its removal and/or bleaching as outlined above.

Preferably the hydrophobic surface comprises a plastics material. Most preferably the plastics material is selected from those plastics used in kitchenware items and in the construction of automatic dishwashers.

Generally the formulation is aqueous. Namely the formulation may be dissolved, suspended or emulsified in an aqueous solution.

It is preferred that the process of the invention is performed in conjunction with an automatic dishwasher. In this way coloured stains, especially those stains caused by tomatoes and tomato based products, may be removed from plastic kitchenware and the plastic components of a dishwasher.

Thus according to a second object of the invention there is provided a process of removing colour stains from a plastics material, characterised in that the stained plastics material is treated in a dishwashing machine with a formulation comprising a salt of sulphophenyl alkyl carbonate.

Most preferably the salt of sulphophenyl alkyl carbonate is sodium p-sulphophenyl octyl carbonate.

Although it is within the scope of the presence invention to use the sodium p-sulphophenyl octyl carbonate at any desired level which achieves the desired bleaching effect, it has been observed that a concentration in the dishwasher washing or rinsing liquor between 0.01 g and 0.6 g/liter, more preferably between 0.01 g and 0.4 g/liter and most preferably between 0.02 g and 0.35 g/liter is normally enough to improve the removal of coloured food soils comprising natural dyestuffs from plastic substrates. The degree of improvement is of course influenced by a number of factors like the length and temperature of the washing or rinsing process and/or the composition of the detergent used in conjunction with the component.

It has been observed that although sodium p-sulphophenyl octyl carbonate in itself is able to deliver good performance in the removal of coloured stains from plastic, the presence of a peroxide component increases its efficiency.

The amount of peroxide component present in the formulation is most preferably expressed in a molar ration relative to the sodium p-sulphophenyl octyl carbonate. Preferably the molar ratio of sodium p-sulphophenyl octyl carbonate to peroxide component is from 1:3 to 1:40, more preferably from 1:3 to 1:20 and most preferably from 1:3 to 1:12.

As the peroxide component there come into consideration, for example, the organic and inorganic peroxides known in the literature and available commercially that provide a bleach function at conventional dishwashing temperatures, for example at from 10 to 95° C. Preferably the formulation contains such a peroxide component.

The organic peroxides are, for example, mono- or polyperoxides, especially organic peracids or salts thereof, such as phthalimidoperoxycaproic acid, peroxybenzoic acid, diperoxydodecanedioic acid, diperoxynonanedioic acid, diperoxydecanedioic acid, diperoxyphthalic acid or salts thereof.

Preferably, however, inorganic peroxides are used, for example persulfates, perborates, percarbonates and/or persilicates. Percarbonate and perborate (especially in monohydrate form) are particularly preferred. Also hydrogen peroxide may be incorporated into the formulation. In this case it will be appreciated that a stabiliser and/or a thickener may be required to provide, for example, adequate stability (i.e. shelf-life) of the hydrogen peroxide. Also where hydrogen peroxide is used, for stability reasons, it may be separated from the rest of the formulation in a separate portion.

It will be understood that mixtures of inorganic and/or organic peroxides can also be used. The peroxides may be in a variety of crystalline forms and have different water contents, and they may also be used together with other inorganic or organic compounds in order to improve their storage stability.

Obviously when the process of the invention is used in an automatic dishwashing operation, the formulation will include in addition to the sodium p-sulphophenyl octyl carbonate and peroxide component any other conventional detergent ingredient including but not limited to compounds belonging to the classes of surfactants, builders, bleaches, bleach activators or bleach catalysts, enzymes, solvents, fillers, tarnishing or corrosion controlling ingredients, perfumes and dyes.

The enzyme is preferably selected from the group consisting of cellulases, hemicellulases, peroxidases, proteases, glucoamylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, beta.-glucanases, arabinosidases, hyaluronidase, chondroitinase, laccase or mixture thereof.

Preferably the enzymatic component comprises an amylase and a protease.

One suitable protease has maximum activity throughout the pH range of 8-12, and is sold as ESPERASE (RTM) by Novo Industries A/S of Denmark. Other suitable proteases include ALCALASE(RTM), DURAZYM (RTM) and SAVINASE (RTM) also from Novo Industries and MAXATASE (RTM), XACAL (RTM), PROPERASE (RTM) and MAXAPEM (RTM) (protein engineered Maxacal) from Gist- Brocades. Further suitable proteases include PURAECT (RTM) (available from Genencor); also EVERLASE (RTM) and OVOZYM (RTM) (available from Novozymes); and KEMZYM (RTM) (available from Biozym).

Suitable protcolytic enzymes also include modified bacterial serine proteases. Other suitable proteases include subtilisins which are obtained from *B. subtilis* and *B. licheniformis*.

Preferred proteases include carbonyl hydrolase variants having an amino acid sequence not found in nature, which are derived from a precursor carbonyl hydrolase by substituting a different amino acid for a plurality of amino acid residues.

The protease enzyme is preferably incorporated in the formulation of the present invention a level of from 0.0001% to 2% pure enzyme by weight of the formulation.

Amylases (alpha and/or beta) are recognised to be suitable for removal of carbohydrate-based stains. Other suitable amylases are stability-enhanced amylases.

Examples of commercial alpha-amylases products are Purastar (RTM) and Purafect Ox Am (RTM) from Genencor. Further suitable commercially available alpha-amylases include Termamyl (RTM), Ban (RTM), Fungamyl (RTM) and Duramyl (RTM), all available from Novo Nordisk A/S Denmark. Termamyl (RTM) is an alpha-amylases characterised by having a specific activity at least 25% higher than the specific activity of at a temperature range of 25° C. to 55° C. and at a pH value in the range of 8 to 10, measured by the Phadebas (RTM) alpha-amylase activity assay.

The amylolytic enzyme is preferably incorporated in the detergent compositions of the present invention a level of from 0.0001% to 2% pure enzyme by weight of the formulation.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Also included by definition, are mutants of native enzymes. Mutants can be obtained e.g. by protein and/or genetic engineering, chemical and/or physical modifications of native enzymes.

As enzymes can react detrimentally with other components of detergent formulations the enzyme may be separated from the remainder of the formulation. Separation is of particular consideration with regard to oxygen sources and oxidising agents, such as bleaches, which are known to cause deterioration of enzymes. The separation may be achieved by physical separation of the formulation into at least two components; such as by the use of a twin chamber bottle, a twin layer tablet or a twin compartment pouch; wherein the enzyme is separated from antagonistic components. An alternative means of separation is by encapsulation. The method of encapsulation and the material used for encapsulation may vary dependent on the physical nature of the formulation. For example in a liquid formulation an encapsulation agent such as wax may be used. Whereas in a solid formation a more rigid encapsulation material, such as a saccharide optionally in combination with a pigment such as titanium dioxide, may be used.

The formulation may contain a surfactant. Preferably the surfactant is present in an amount of up to 30 wt % of the formulation and more preferably up to 10 wt % of the formulation.

Suitable surfactants are selected from anionic, cationic, ampholytic and zwitterionic surfactants and mixtures thereof. As the formulation is for use in automatic dishwashing the surfactant is preferably low foaming in character. To achieve this aim the surfactant system for use in dishwashing methods may be suppressed.

Nonionic surfactants are preferred for incorporation into the formulation as they are recognised to provide a suds suppression benefit. The alkyl ethoxylate condensation products of an alcohol with from 1 to 80 moles of an alkylene (liner/branched aliphatic/aromatic optionally substituted $C_2$ to $C_{20}$ alkylene) oxide are suitable for this use. The alkyl chain of the alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol. In this regard Suitable surfactants include POLY-TERGENT® SLF-18B nonionic surfactants by Olin Corporation.

Ethoxylated $C_6$-$C_{18}$ fatty alcohols and $C_6$-$C_{18}$mixed ethoxylated/propoxylated fatty alcohols are suitable surfactants for use herein. Preferably the ethoxylated fatty alcohols are the $C_{10}$-$C_{18}$ ethoxylated fatty alcohols with a degree of ethoxylation of from 3 to 50, most preferably these are the $C_{12}$-$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

The condensation products of ethylene oxide with a hydrophobic base formed by the condensation of propylene oxide with propylene glycol are suitable for use herein. The hydrophobic portion of these compounds preferably has a molecular weight of from 1500 to 1800 and exhibits water insolubility. Examples of compounds of this type include certain of the commercially-available Pluronic™ surfactants, marketed by BASF.

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a Molecular weight of from 2500 to 3000. Examples of this type of nonionic surfactant include certain of the commercially available Tetronic™ compounds, marketed by BASF.

In a preferred embodiment of the present invention the formulation comprises a mixed nonionic surfactant system.

The formulation may contain a builder/co-builder. Preferably the builder and/or co-builder is present in an amount of up to 90 wt % of the formulation and more preferably lip to 75 wt % of the formulation.

By co-builder it is meant a compound which acts in addition to a builder compound to sequester (chelate) heavy metal ions. These components may also have calcium and magnesium chelation capacity, but preferentially they show selectivity to binding heavy metal ions such as iron, manganese and copper. Co-builders, which are typically acidic, having for example phosphonic acid or carboxylic acid functionalities, may be present either in their acid form or as a complex/salt with a suitable counter cation such as an, alkali or alkaline metal ion, ammonium, or substituted ammonium ion, or any mixtures thereof. The molar ratio of said counter cation to the co-builder is preferably at least 1:1. Suitable co-builders for use herein include organic phosphonates, such as the amino alkylene poly(alkylene phosphonates), alkali metal ethane 1-hydroxy disphosphonates and nitrilo trimethylene phosphonates. Preferred among the above species are diethylene triamine penta (methylene phosphonate), ethylene diamine tri(methylene phosphonate)hexamethylene diamine tetra(methylene phosphonate) and hydroxyethylene 1,1 diphosphonate. Other suitable co-builders for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Suitable water-soluble builder compounds include the water soluble carboxylates or their acid forms, homo or copolymeric polycarboxylic acids or their salts in which the polycarboxylic acid comprises at least two carboxylic radicals separated from each other by not more than two carbon atoms, carbonates, bicarbonates, borates, phosphates, and mixtures of any of the foregoing. The carboxylate or polycarboxylate builder can be monomeric or oligomeric in type although monomeric polycarboxylates are generally preferred for reasons of cost and performance. Suitable carboxylates containing one carboxy group include the water soluble salts of lactic acid, glycolic acid and ether derivatives thereof. Suitable polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulphinyl carboxylates. Suitable polycarboxylates containing three carboxy groups include, in particular, water-soluble citrates, aconitrates and citraconates as well as succinate derivatives, lactoxysuccinates, and aminosuccinates, and the oxypolycarboxylate materials such as 2-oxa-1,1,3-propane tricarboxylates. Polycarboxylates containing four carboxy groups include oxydisuccinates, 1,1,2,2-ethane tetracarboxylates, 1,1,3,3-propane tetracarboxylates and 1,1,2,3-propane tetracarboxylates. Suitable polycarboxylates containing sulphur substituents include the sulphosuccinate derivatives, and the sulphonated pyrolysed citrates. Suitable alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Suitable aromatic polycarboxylates include mellitic acid, pyromellitic acid and the phthalic acid derivatives. Of the above, the preferred polycarboxylates are hydroxycarboxylates containing up to three carboxy groups per molecule, more particularly citrates. The parent acids of the monomeric or oligomeric polycarboxylate chelating agents or mixtures thereof with their salts, e.g. citric acid or citrate/citric acid mixtures are also contemplated as useful builder components. Borate builders, as well as builders containing borate-forming materials that can produce borate under detergent storage or wash conditions can also be used. Examples of suitable carbonate builders are the alkaline earth and alkali metal carbonates, preferably the sodium and potassium salts, including sodium carbonate and sesqui-carbonate and mixtures thereof with ultra-fine calcium carbonate. Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation preferably ranges from 6 to 21, and salts of phytic acid. Specific examples of suitable water-soluble phosphate builders are the alkali metal tripolyphosphates, sodium and potassium and ammonium pyrophosphate, sodium and potassium orthophosphate, sodium polymetaphosphate in which the degree of polymerization preferably ranges from 6 to 21, and salts of phytic acid.

The formulation may comprise an additional component which is typically associated with an automatic dishwasher detergent. Preferred examples of such additional components includes preservatives such as isothiazolinone, dyes, corrosion inhibitors (both dishwasher machine and glass/kitchenware corrosion inhibitors), perfumes, stability aids and dispersing aids.

The formulation may take the form of a complete dishwashing detergent or in the alternative may take the form of a separate bleaching additive. In the latter case the bleaching additive may used for removing coloured stains on crockery/kitchenware in a separate liquor before the items are washed in a dishwasher. The bleaching additive can also be used in a liquor together with either a bleach-free washing agent or a bleach-containing washing agent as a bleach booster.

When in the form of a complete dishwashing detergent the formulation preferably comprises from 1 to 15 wt % of the salt of sulphophenyl alkyl carbonate, more preferably from 1 to 10 wt % and most preferably from 1 to 7 wt %.

When in the form of a bleaching additive the formulation preferably comprises up to 100 wt % of the salt of sulphophenyl alkyl carbonate, more preferably from 1 to 90 wt % and most preferably from 1 to 50 wt %.

The formulation according to the invention may be in solid or liquid form. The liquid may be homogenous or multi-phase. One or more of the formulation components may be present in the form of a suspension.

When in liquid form the formulation may comprise a thickener, such as is commonly use to increase the viscosity of the formulation and appeal to the consumer. Preferred examples of such thickeners include Xantham gum, cellulose derivatives and polyacrylic acid derivatives. A preferred commercially available thickener is sold under the tradename Carbopol (available from BF Goodrich).

The formulation may be in the form of a powder. The powder may also be compressed into tablet form. If in tablet form the formulation may include a tabletting aid such as polyethyleneglycol.

The invention is illustrated with reference to the following examples.

Method of Evaluation of Coloured Food Soil Removal:

A method for the evaluation of coloured food soil removal from plastic has been developed and is used to evaluate the results obtained with the process and compositions of the present invention and to compare them with the results obtained with conventional dishwashing processes.

The evaluation method consist in the following steps:

Preparation of stained plastic articles

Washing of the stained articles in dishwasher with the compositions of the invention a Colorimetric assessment of the degree of stain removal.

Preparation of Standard Soiled Plastic Articles:

Commercially available plastic containers made of isotactic polypropylene, as offered in the US market by Curver-Rubbermaid®, where washed twice in a Bosch SGS5602 machine with water of 2° of German hardness at 55° C. using a Calgonit Powerball® tablet dishwashing detergent.

The reflectance ($R_0$) of the washed containers was measured with a spectrophotometer (Mahlo® color guide 45/0).

The same containers were subsequently washed twice in the same dishwasher and under identical conditions but replacing the detergent by 150 g of Ketchup (Heinz®) and the reflectance of the stained containers ($R_i$) was measured again with the same apparatus.

Method of Stain Removal:

The different compositions where evaluated using a dishwasher (GE Quiet Power 3®) and both the pre-wash cycle and the main wash cycle were run with water at 55° C. The soiled containers where placed vertically (with their mouth looking to the side) on the higher rack of the dishwasher and the compositions to be tested where dosed in the corresponding pre-wash and main wash compartments of the machine. After the completion of the machine program the stained containers where taken out of the machine and the reflectance ($R_f$) of the base of the containers was determined using a spectrophotometer (Mahlo® color guide 45/0).

The parameter TSRI (tomato stain removal index) was calculated using the following formula:

$$TSRI = \frac{Ro - Rf}{Ro - Ri} * 100$$

Obviously a perfect stain removal is characterised by a treated article having a reflectance as high as that of the unstained original article and thus a TSRI of 100. An article were no stain removal would have been achieved would show a reflectance identical to that of the stained container and thus a TSRI of 0.

EXAMPLES

To evaluate the performance of compositions in comparison with state-of-the art compositions, containers, which had been stained with tomato, as described above were washed in a dishwasher (GE Quiet Power 3®) using 20 g of the formulation as shown in Table 1,

TABLE 1

| White Powder Mixture | | Blue Powder Mixture | |
|---|---|---|---|
| Raw Materials | % | Raw Materials | % |
| Sodium perborate monohydrate | 14.29 | Sodium tripolyphosphate | 34.00 |
| Sodium carbonate | 39.78 | Sodium bicarbonate heavy | 21.73 |
| Sodium tripoly-phosphate | 34.00 | Citric acid | 10.00 |
| Sodium disilicate P 50 | 0.71 | Homopolymer (LMW 45) | 2.60 |
| Homopolymer (LMW 45) | 1.74 | Microcellulose, Disintigrator | 2.00 |
| Polyethyleneglycol 6000 | 1.00 | Polyethyleneglycol | 5.00 |
| Benzotriazole (BTA) granular | 0.03 | Sodium p-sulpho-phenyl octyl carbonate | 20.62 |
| Dye | 4.28 | Amylase 4000 V | 1.00 |
| (Surfactant Nonionic EO/PO) (LF 403) | 2.86 | Properase 4000 D | 2.33 |

TABLE 1-continued

| White Powder Mixture | | Blue Powder Mixture | |
|---|---|---|---|
| Raw Materials | % | Raw Materials | % |
| Glycerol (99%) | 1.25 | Dye | 0.03 |
| Fragrance | 0.05 | Glycerol (99%) | 0.68 |
| | 100.0000 | | 100.0000 |

The formulation comprised 70 wt % white powder and 30 wt % blue powder.

The % TSRI results of this tablet compound to 3 other commercially available formulations are shown in Table II.

TABLE II

| Formulation | Soil Removal % |
|---|---|
| Powder of Table 1 | 62 |
| Commercial A | 2 |
| Commercial B | 3 |
| Commercial C | 14 |

These results clearly show the surprising efficacy of sodium p-sulphophenyl octyl carbonate at addressing tomato satins on plastic materials. Indeed it can be seen from the comparison with three known commercial available preparations which contain known bleach activating compounds (such as TAED) that the soil removal is greatly enhanced. The removal of tomato stains on plastic using sodium p-sulphophenyl, octyl carbonate is shown to be at least four times as effective at removing the tomato stains as the next most effective composition. It is proposed that the surprising efficacy of the sodium p-sulphophenyl octyl carbonate arises by virtue of its ability to interact favourably with hydrophobic surfaces such as plastic.

The invention claimed is:

1. A process of removing colour stains from a stained plastic kitchenware and the plastic components of a dishwasher, characterised in that the said stained plastic kitchenware and the plastics components of a dishwasher is treated in a dishwashing machine with a formulation comprising a salt of sulphophenyl alkyl carbonate.

2. A process according to claim 1 wherein the salt of sulphophenyl alkyl carbonate is sodium p-sulphophenyl octyl carbonate.

3. A process according to claim 1 wherein the salt of sodium sulphophenyl alkyl carbonate is present in a dishwasher washing or rinsing liquor used to contact the stained plastic kitchenware and the plastics components of a dishwasher at between 0.01 g and 0.6 g/liter.

4. A process according to claim 1 wherein the formulation comprises an oxygen source selected from a perborate, percarbonate, hydrogen peroxide or a mixture thereof.

5. A process according to claim 4, wherein the oxygen source is present in the formulation in a molar ratio of salt of sulphophenyl alkyl carbonate to oxygen source of from 1:3 to 1:40.

6. A process according to claim 1 wherein the formulation further comprises an enzyme component.

7. A process according to claim 6, wherein the enzyme component comprises an amylase or a protease.

8. A process according to claim 6 wherein the enzyme is initially separated from a component of the formulation.

9. A process according to claim 8, wherein the enzyme is encapsulated.

10. A process according to claim 1 wherein the formulation further comprises a builder.

11. A process according to claim 1 wherein the formulation further comprises a surfactant.

12. A process according to claim 11, wherein the surfactant is a nonionic low sudsing surfactant.

* * * * *